United States Patent [19]

Haftmann et al.

[11] 4,213,715

[45] Jul. 22, 1980

[54] INK RIBBON CARTRIDGE HAVING A REPLACEABLE RIBBON MAGAZINE

[75] Inventors: Johannes Haftmann, Borchen-Doerenhagen; Rudolf Schmeykal, Neuenbeken, both of Fed. Rep. of Germany

[73] Assignee: Nixdorf Computer AG, Paderborn, Fed. Rep. of Germany

[21] Appl. No.: 894,591

[22] Filed: Apr. 7, 1978

[30] Foreign Application Priority Data

Apr. 18, 1977 [DE] Fed. Rep. of Germany ..... 2717076

[51] Int. Cl.[3] ..... B41J 33/10

[52] U.S. Cl. ..... 400/196.1; 400/82; 400/195; 400/207; 400/234; 400/202.4

[58] Field of Search ..... 400/82, 194, 195, 196, 400/196.1, 202.4, 207, 208, 208.1, 234, 636

[56] References Cited

U.S. PATENT DOCUMENTS

| | | | |
|---|---|---|---|
| 1,482,753 | 2/1924 | Lasker | 400/194 |
| 1,890,563 | 12/1932 | Degener | 400/636 X |
| 3,260,344 | 7/1966 | Doyle | 400/208 |
| 3,758,012 | 9/1973 | Bonner et al. | 400/234 X |
| 3,825,681 | 7/1974 | Cederberg et al. | 400/82 X |
| 3,863,749 | 2/1975 | Perry et al. | 400/208 |
| 3,882,989 | 5/1975 | Morelli | 400/208 |
| 3,899,065 | 8/1975 | Brignole | 400/208 |
| 3,904,016 | 9/1975 | Hengelhaupt | 400/208 |
| 3,910,396 | 10/1975 | Eischen et al. | 400/82 |
| 3,924,727 | 12/1975 | Morelli | 400/208.1 |
| 3,977,512 | 8/1976 | Teagarden et al. | 400/196.1 X |
| 3,989,132 | 11/1976 | Carson | 400/196.1 X |
| 4,091,914 | 5/1978 | Stipanuk | 400/202.4 X |
| 4,113,750 | 9/1978 | Isobe | 400/196 X |

FOREIGN PATENT DOCUMENTS

| | | | |
|---|---|---|---|
| 603257 | 9/1934 | Fed. Rep. of Germany | 400/194 |
| 2527979 | 1/1977 | Fed. Rep. of Germany | 400/194 |
| 2550305 | 5/1977 | Fed. Rep. of Germany | 400/196.1 |
| 2718688 | 11/1977 | Fed. Rep. of Germany | 400/196 |
| 29235 | of 1913 | United Kingdom | 400/196.1 |

*Primary Examiner*—Ernest T. Wright, Jr.
*Attorney, Agent, or Firm*—Krass & Young

[57] ABSTRACT

A cassette-type ink ribbon device for a printer wherein the inked ribbon is carried in a throw-away magazine operatively disposed within and wholly independent of the cassette body. The cassette body carries all of the drive components and, hence, replacement of the magazine revitalizes the cassette at minimum expense.

16 Claims, 4 Drawing Figures

INK RIBBON CARTRIDGE HAVING A REPLACEABLE RIBBON MAGAZINE

INTRODUCTION

The invention relates to an ink ribbon device for printing units, with a storage compartment showing an inlet and an outlet opening for an endless ink ribbon stored in loops lying one on another and with a ribbon guide device attached to the storage compartment for guiding the endless ink ribbon from the outlet opening through at least one printing region to the inlet opening.

BACKGROUND OF THE INVENTION

A device of this kind is known, for example, from German Published Application No. 2,536,645. It is constructed as a magazine which can be inserted as a whole in a printing unit and makes it possible to store a large amount of ink ribbon in a relatively small storage compartment. The ink ribbon is continuously slipped into the storage compartment by means of a drive arranged in the magazine, during the operation of the printing unit, and at the same time is drawn out of the storage compartment at the outlet opening by the action of the drive. Outside of the storage compartment it runs through the ribbon guide device and is thereby guided through a printing region in which for example a stylus force head, by acting on the ink ribbon in the manner of a letter causes a transfer of ink from the ink ribbon onto a track support.

Such a magazine-type ink ribbon device, after the printing ink present on the ink ribbon has been used up, can be taken bodily out of the printing unit and be replaced by a new ink ribbon device. But this replacement is relatively expensive, since changing the used ink ribbon necessarily involves changing its guide. If a repeated use of the ink ribbon device is to be made possible to save expense, which is especially important when there are a large number of printing units present in a large-scale operation, e.g. in cash registers of department stores or supermarkets, then the magazine-like ink ribbon devices must be loaded with fresh ink ribbons after they are taken out of the printing units. This work is tedious and causes a great smudging of the hands. Besides, this requires not only an expenditure of time but also a certain knack which cannot readily be expected of the operating staff, of a cash register for example. If the ink ribbon is to changed after long time intervals, then the utilization of the ink ribbon must be prolonged, which in turn leads to an increased expense of the ink ribbon material.

SUMMARY OF THE INVENTION

It is the object of the invention to supply an ink ribbon device for printing units which permits a repeated use of the ribbon guide device and of the ribbon drive with a very easy and tidy changing of the ink ribbon. At the same time, it should be possible to prolong the useful life of the ink ribbon as compared with the previous situation, in such a way that, especially in large-scale operations, few ink ribbon units need be relatively seldom replaced or refilled with ink ribbon.

An ink ribbon device of the type mentioned earlier is designed to solve this problem, according to the invention, in such a way that the storage compartment is constructed as a replaceable ink-ribbon magazine with ribbon, which magazine can be inserted in a recess in the band guide device shaped to correspond with its outline, and that the recess has guide and driving elements for the ink ribbon assigned to it in the region of the inlet and outlet opening of the ink ribbon magazine.

Through the invention, it is managed that on the one hand an ink ribbon device is integrally built into a printing unit, but on the other hand it can also be constructed as a replaceable magazine. In any case, it is very simple to replace the ink ribbon, since the storage compartment is a so-called throw-away magazine which contains only the ink ribbon in loops lying one on another, not the guide and drive elements also. Thus, in replacing an ink ribbon, it is only necessary to remove the old ink ribbon magazine with its ink ribbon from the ink ribbon device and insert the new ink ribbon magazine, for which the new ink ribbon which is guided around the ink ribbon magazine in loops now only need be loaded into the ribbon guide device. Thus, any tedious packing of the ink ribbon in loops lying one on another in a storage compartment is unnecessary, but rather this has already been done in the course of the manufacture of the ink ribbon. The ink ribbons can be supplied in ink ribbon magazines by the manufacturer ready to be installed.

An ink ribbon device according to the invention essentially consists of two main parts, namely, the ink ribbon guide device and the throw-away magazine. The ink ribbon guide device for its part can be constructed in magazine form and contains all the parts necessary for the movement of the ink ribbon through one or more printing regions. Since it can be used repeatedly and does not require a new ribbon guide device at the same time that the ink ribbon is replaced, parts can be provided such as previously had to be omitted to save expense. Thus, for example, it is possible to provide the ribbon guide device with an inking device for the ribbon, arranged in the path of the ink ribbon. This inking device may for example be a roller inked with printing ink over which the ink ribbon passes, in such a way that the printing ink is transferred to the ink ribbon. When the inking device is arranged between the printing region and the inlet opening of the ink ribbon magazine, then a satisfactory distribution of the ink in the ribbon is assured, since the freshly inked ink ribbon first remains in the storage compartment before it again runs through to the printing region. The added inking device prolongs the useful life of the ink ribbon substantially, and so in this way, too, the number of ink ribbon replacements required is reduced.

It is advantageous for the section of the ribbon guide device having the inking device to be designed in trough form. In this way, it is managed that any printing ink coming out of the inking device will be collected in the trough-shaped section and not leave the ink ribbon device.

The ink ribbon device can be designed in combination with the inking device in such a way that the inking device shows an inking roller touching the ink ribbon and a feed roller rolling on this, preferably a replaceable feed roller storing printing ink. The additional inking roller assures an especially uniform application of printing ink to the ink ribbon, and it is possible to replace the feed roller without the guiding of the ink ribbon being disturbed. It is advantageous for the feed roller to be changed at the same time as the ink ribbon magazine. Therewith, it is then unimportant whether the feed roller is changed before or after the loading of the fresh ink ribbon.

It is known that the utilization of the ink ribbon can be improved by the formation of a so-called Mobius strip. This involves a simultaneous utilization of the whole surface of the ribbon and not merely one part of the ink ribbon. The formation of a Mobius strip is especially simple with an ink-ribbon device according to the invention, and no additional moving mechanical elements are needed for this. The ink ribbon device can be further developed for this purpose by placing a chamber in the path of the ink ribbon beyond the outlet opening of the ink ribbon magazine and inside the ink ribbon guide device, which chamber contains stationary guide elements for the formation of a Mobius strip in the ink ribbon. If a new ink ribbon magazine is loaded into the ink ribbon device, then the ink ribbon loop emerging from the ink ribbon magazine can be loaded into the ribbon guide device starting at the inlet opening, in which case it will run through the chamber for forming the Mobius strip last, or just before it reaches the outlet opening. The inversion of the ribbon then takes place on the stationary guide elements which are arranged in this chamber.

When the ink ribbon device is made in the form of a replaceable magazine, it is advantageous for it to have a supporting member embracing the recess for the ink ribbon magazine as well as the guide and driving elements assigned to it and to have a ribbon guide device enclosing at least one numbering box of a printing unit in the manner of a frame. The ribbon guide device advantageously forms a polygonal guide path for the ink ribbon, on the corners of which are arranged perpendicular guide studs over which the ink ribbon is passed in contact under tension. In this manner a feeding of the ribbon is assured with the ink ribbon moving practically unencumbered, in which way only a very few friction points exist on the corners of the polygonal guided path.

In order to assure a dust-free feeding of the ink ribbon, especially in the region of the driving elements and the inking device, a hinged cover is provided which covers the recess for the ink ribbon magazine, the section receiving the driving elements and the inking device and covers the chamber containing the Mobius strips. This hinged cover is connected with the ink ribbon device by way of open hinge joints. It proves particularly advantageous when the ink ribbon device is designed as an interchangeable magazine which is put in very varied positions in its manipulation. By means of the hinged cover it is managed that the proper ink ribbon magazine is secured against falling out of the ink ribbon device, and moreover any smudging, of the driving elements in particular, is avoided.

At the same time, the guide elements for the Mobius strip can be arranged in the region of the chamber provided for this one the hinged cover, so that the formation of the Mobius strip takes place in a simple manner on closing the hinged cover.

BRIEF DESCRIPTION OF THE DRAWING

An embodiment example of an ink ribbon device according to the invention is described in the following on the basis of the figures. In the drawing.

DETAILED DESCRIPTION OF THE SPECIFIC EMBODIMENT

Figure 1:
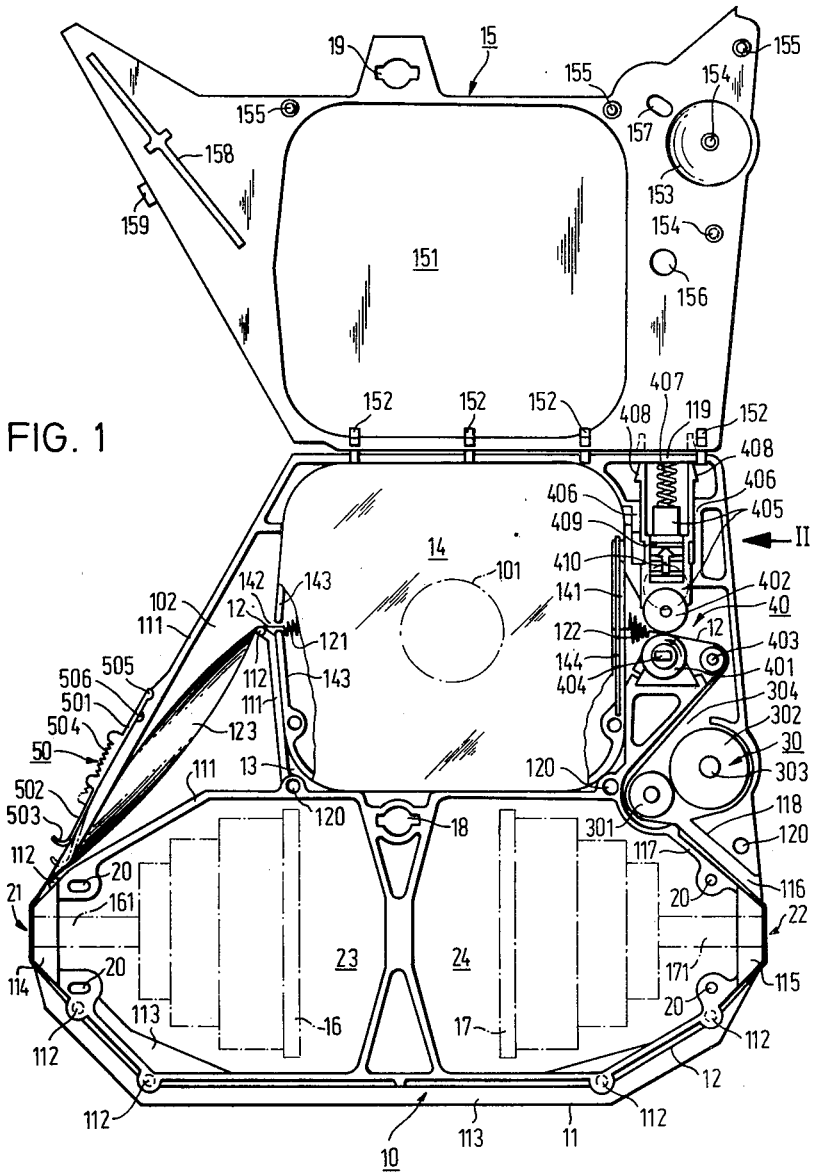
FIG. 1 shows a top plan view of an ink ribbon device according to the invention with an inserted ink ribbon magazine and opened hinge cover according to the view direction I in FIG. 2.

In FIG. 1 is represented an ink ribbon device 10, which essentially embraces a ribbon guide device 11 for the guiding of an ink ribbon 12, a recess 13 for an ink ribbon magazine 14 and a hinged cover 15. The whole ink ribbon device 10 is represented in FIG. 1 in the opened state in a top plan view, i.e., the hinged cover 15 is lifted up so that an ink ribbon magazine 14 inserted in the recess 13 as well as the ink ribbon 12 running through the ribbon guide device 11 are recognizable. Moreover, two numbering boxes 16 and 17 are represented in dot-dash lines which denote that the whole ink-ribbon device 10 is inserted in a printing unit in such a way that their frame-like ribbon guide device 11 encloses both numbering boxes 16 and 17. This construction of the ink-ribbon device 10 is only an embodiment example; similarly, a construction is also possible such that the ribbon guide device 11 encloses only a single numbering box, when the ink-ribbon device 10 is to be placed in printing units with only one numbering box.

The ink-ribbon device 10 shown in FIG. 1 can either be built integrally into a printing unit or else can be constructed as replaceable magazines. For its use as magazines, in particular, central openings 18 and 19 in the ribbon guide device 11 and the hinged cover 15 are advantageous, which permit the anchoring of the ink ribbon device 10 on a fastening pin (not shown) in a printing unit, which at the same time permits the locking of the magazine cover 15 in a manner yet to be described. Moreover, for use as replaceable magazines, openings 20 are provided in the body of the ribbon guide device 11 into which pins anchored in the printing unit, which are not shown, are introduced when the ink-ribbon device 10 is inserted, so that a satisfactory alignment of the ink ribbon device 10 relative to one or more numbering boxes 16 and 17 is assured. Some of the openings 20 can be designed as slots, as is shown for the left two openings 20 in FIG. 1, in order to be able to compensate for possible size tolerances of different ink ribbon devices 10.

The ink ribbon magazine 14 contains the ink ribbon 12, in the form of loops 121 lying one on another in such a way that a very large amount of ink ribbon 12 can be stored in the magazine 14 in a known manner. The ink ribbon magazine 14 has an approximately square cross section and can be designed as a plastic injection-molded part closed on all sides. By reason of the cutaway representation, the loops 121 in the interior of the ink ribbon magazine 14 are recognizable. The ink ribbon magazine 14 has an inlet opening 141 and an outlet opening 142. The outlet opening 142 has about the width of a slot, and the ink ribbon 12 is drawn out of it by the action of a drive yet to be described. The inlet opening 141 is designed relatively broad, so that the ink ribbon 12 can be pushed into it with the formation of loops 122. The ink ribbon magazine 14 can be taken out of the ink ribbon device 10 with the endless ink ribbon 12 stored in it or connected with the outlet opening 142 outside the inlet opening 141, i.e., it is possible to renew the ink ribbon 12 merely by replacing the relatively simply designed ink ribbon magazine 14. The square cross section of the ink ribbon magazine 14 permits the ink ribbon 12 to be drawn uniformly out of the outlet opening 142, since the ink ribbon loops 121 present in a uniform distribution in the ink ribbon magazine 14 are altogether at a comparatively short distance from the outlet opening 142, so that a uniform propulsion of the ink ribbon 12 through the ink ribbon magazine 14 is insured. The gentle withdrawing of it from a region immediately adjacent to the outlet opening 142 also is favored by the fact that in this region the magazine walls 143 have a contour oblique to the conveying direction of the ink ribbon 12.

In order to make the removal of the ink ribbon magazine 14 from the ink ribbon device 10 easier, an opening 101, represented in a dot-dash line, is provided in the bottom of the cartridge, which makes it possible to eject the ink ribbon magazine 14 therefrom by finger pressure.

After the ink ribbon 12 passes through the ink ribbon magazine 14, it is brought out of the outlet opening 142 and next reaches a chamber 102 enclosed by walls 111 of the ribbon guide device 11 in an approximately triangular shape, in which chamber 102 it is inverted into the form of a Mobius strip 123. After this, it is guided over a polygonal guide path, which in the embodiment example represented embraces two printing regions 21 and 22, in which the printing elements 161 or 171 of the respective numbering box 16 and 17 can act by way of the ink ribbon 12 on a track support or platen which is not illustrated. The guiding of the ink ribbon 12 through the two printing regions 21 and 22 is done by way of the ribbon guide device 11 which, to achieve a polygonal guide path and thereby the fewest possible friction points on the corners of this guide path, shows guide studs 112 around which the ink ribbon 12 is guided outward. The ink ribbon 12 here has its bottom edge on the bottom 113 of the ribbon guide device 11, which achieves a greater rigidity of the frame construction of the ribbon guide device 11 formed by vertical walls. The bottom 113 is broken at 23 and 24 to make possible the insertion of the ink ribbon device 10 between the numbering boxes 16 and 17.

Instead of stationary guide studs 112, guide rollers can also be provided, whereby the ribbon friction is further reduced. Suitable constructions are familiar to one skilled in the art.

At the printing regions 21 and 22 the walls of the ribbon guide device 11 are pierced to permit the action of the printing elements 161 and 171 on a track support. Here the ink ribbon 12 is likewise guided past on guide studs which are provided between the bottom 113 and two covering areas 114 and 115. These together with the bottom 113 and the walls of the ribbon guide device 11 form a stable guide construction for the ink ribbon 12 at the printing regions 21 and 22, so that here in particular the guiding of the ink ribbon 12 with an always accurate alignment is assured.

After passing through the printing region 22 the ink ribbon 12 is guided through a channel 116, which is formed between two vertical walls 117 and 118, of an inking device 30 which embraces a coating roller 301 and a feed roller 302. The feed roller 302 is soaked with printing ink and transfers this to a coating roller 301, so that in this way the ink ribbon 12 winding around it is continually provided with printing ink. In this way the useful life of the ink ribbon 12 is prolonged, since due to the fact that the inking device 30 is arranged before the inlet opening 141 of the ink ribbon magazine 14 in the path of the ink ribbon 12, the relatively long time spent by the ink ribbon 12 in the ink ribbon magazine 14 can contribute to the uniform distribution of the printing ink in the ink ribbon 12. The feed roller 302 can be attached in interchangeable form to its shaft 303, so that with a replacement of the ink ribbon 12 a replacement of the feed roller 302 is also possible.

The bottom 113 of the ribbon guide device 11 can be constructed in trough form at 304, i.e., in the region of the feed roller 302, so that any printing ink possibly emerging from the feed roller 302 is collected in this section and any escape of printing ink into a printing unit in which the ink ribbon device 10 is inserted is prevented.

After passing the ink device 30, the ink ribbon 12 reaches the region of a drive device 40 which is essentially a driving roller 401 rotating in the direction of the arrow, a back-up roller 402 interacting with this and a ribbon guide roller 403. The ink ribbon 12 is guided over the ribbon guide roller 403 and between the driving roller 401 and the back-up roller 402. The driving roller 401 has a central recess 404 deviating from a circular shape, into which a drive pin (not shown) is forced after the insertion of the ink ribbon device 10 into a printing unit and rotates the driving roller 401 in the direction of the arrow. Through the action of the driving roller 401 and the back-up roller 402, the ink ribbon 12 is slipped through the inlet opening 141 into the ink ribbon magazine 14, whereby ink ribbon loops 122 lying one on another are formed immediately behind the two rollers 401 and 402.

The ribbon guide roller 403 advantageously has a barrel-shaped lengthwise cross section, whereby in a known manner a guiding of the ink ribbon 12 at an always constant level is assured, so that the ink ribbon 12 uniformly goes between the driving roller 401 and the back-up roller 402, and no trouble can occur in the formation of loops 122, especially in slipping the loops 122 into the ink ribbon magazine 14.

The back-up roller 402 is retained on a support part 405 which is mounted in a guide 406 in a movable form. A spring 407 which is supported on a wall 119 of the ink ribbon device 10, presses the support part 405 and thereby the back-up roller 402 against the ink ribbon 12 or the driving roller 401. The support part 405 is provided on its two side arms with locking elements 408 which can pass through openings in the wall 119, so that when the support part 405 as represented in FIG. 1 is moved, they are passed upward out of the ink ribbon device 10 and are locked on the outside of the wall 119. This position of the locking elements 408 is represented in a broken line in FIG. 1. The back-up roller 402 is then spaced apart from the driving roller 401, in which way it is possible to replace the ink ribbon 12 with the ink ribbon magazine 14.

The support part 405, for easier movement, is provided on its top side with a groove 409, which can also show an arrow symbol 410 to facilitate the appropriate servicing work for the servicing personnel in replacing the ink ribbon 12.

The ribbon guide device 11 is provided before the printing region 21 with a brake 50, which embraces a slide 501 and a spring element 502 which is bent sidewise at its front end 503. The slide 501 has a corrugated surface 504, so that it can be manually moved on the left wall 111 in FIG. 1 of the ribbon guide device 11 on which it is guided in a suitable groove. The braking device 50 is shown in FIG. 1 in solid lines in an open state, in which it does not act with its front end 503 on the ink ribbon 12. The slide 501 has on its rear end a locking element 505 with which it locks in a corresponding rear recess of the wall 111. If it is manually moved into the position represented in a broken line, then the locking element 505 locks in another recess 506, which is arranged so that in the braking position then reached, the front end 503 presses the ink ribbon 12 against the guide pin 112 provided there and thus exerts a braking action on the ink ribbon 12. Through the action of the driving device 40 and the braking device 50, the ink ribbon 12 is kept stretched over the whole path between the two printing regions 21 and 22. On the other hand, in the chamber 102 there is a satisfactory formation of the Mobius strip 123.

The hinged cover 15 is provided with an indentation 151 which is made so that a part of the ink ribbon magazine 14 extending upward out of the ink ribbon device 10 is reliably enclosed and retained when the hinged cover 15 is brought to the closed position. The hinged cover 15 is pivoted on the ink ribbon device 10 with hinged joint elements 152. These hinged joint elements 152 may be so-called open hinge joints, so that it is possible to remove the hinged cover 15 from the other part of the ink ribbon device 10. Open hinge joints may consist of a plastic softer than the other parts of the ink ribbon device 10, so that it is possible to release the hinged cover 15 in the manner of a snap movement.

The hinged cover 15 moreover has in its inner surface a trough-shaped depression 153 at a point which corresponds to the position of the feed roller 302 of the inking device 30. The task of the trough-shaped depression 153 corresponds to that of the trough-shaped section 304 already described in the bottom 113 of the ribbon guide device 11.

The hinged cover 15 is also provided with pins 154 which serve for the guiding of the feed roller 302 or for supplementing its shaft 303 as well as the ribbon guide roller 403. Further, pins 155 reach their assigned guide openings 120 in the ribbon guide device 11 when the hinged cover 15 is closed, in which way an always accurate alignment of the hinged cover 15 with the other parts of the ink ribbon device 10 is assured.

The hinged cover 15 moreover has an opening 156 which is assigned to the driving roller 401 and also makes possible the manual rotation of this roller 401 on a pin, done from above. Another opening 157 makes possible access to the inking roller 301 so that if necessary the latter can be adjusted relative to the feed roller 302. Suitable elements for this are familiar to one skilled in the art and therefore are not represented in more detail.

The hinged cover 15 moreover has, in the section assigned to the Mobius strip 123, a guide stud 158 which is approximately cross-shaped in its design and facilitates the formation of the Mobius strip 123 in the chamber 102 of the ribbon guide device 11.

Figure 4:
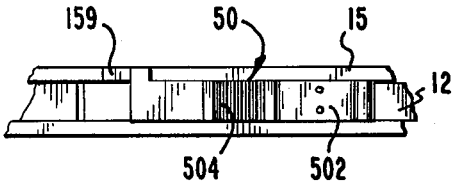
FIG. 4 is a detail of an ink ribbon brake.

As best shown in FIG. 4, an external projection 159 on the hinged cover 15 interferes with a tab on the device 50 such that the braking device 50 can be brought into the open position represented in solid lines in FIG. 1 only when the hinged cover 15 is opened. On the other hand, this can be closed only when the braking device 50 has first been brought into the braking position, which is represented in FIG. 1 in broken lines.

The ink ribbon magazine 14, which must have a relatively large inlet opening 141, can be closed by a special slide 144 for storage outside the ink ribbon device 10. This has only one slot opening, so that no drying out or smudging of the ink ribbon 12 during storage due to the relatively large inlet opening 141 need be feared. The slide 144 is removed from the ink ribbon magazine 14 before the hinged cover 15 is closed.

Figure 2:
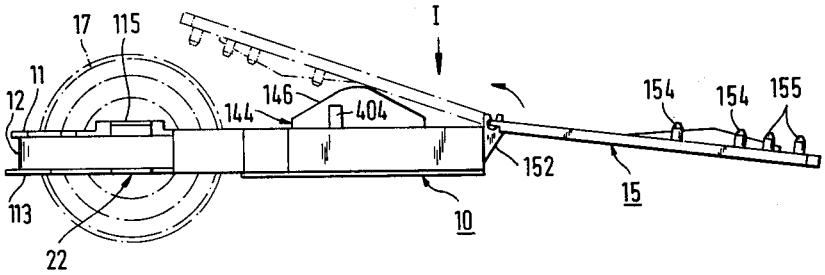
FIG. 2 shows a side elevation of the ink ribbon device with opened hinged cover in FIG. 1, according to the view direction II in FIG. 1.

In FIG. 2 the ink ribbon device 10 is represented in a side view, which corresponds to a view direction from the right relative to the representation according to FIG. 1. The hinged cover 15 is shown in the open position, and moreover an open hinge joint 152 is recognizable.

It is denoted in FIG. 2 that the hinged cover 15 is swung in the direction of the arrow to close the ink ribbon device 10. This swinging motion is possible only when the slide 144 has first been removed by its upper part 146, which forms a handle, from the ink ribbon magazine 14 of FIG. 1.

Moreover, in FIG. 2 the assignment of the ink ribbon device 10 to a numbering box 17 can be recognized; this numbering box 17 is represented in dot-dash lines as in the representation in FIG. 1.

In FIG. 2, it can also be seen how the cover 115 on the ribbon guide device 11 forms a rigid guide construction for the ink ribbon 12 in the printing region 22. Therewith, the ink ribbon 12 is steadily fed to the bottom 113 of the ribbon guide device 11.

Figure 3:
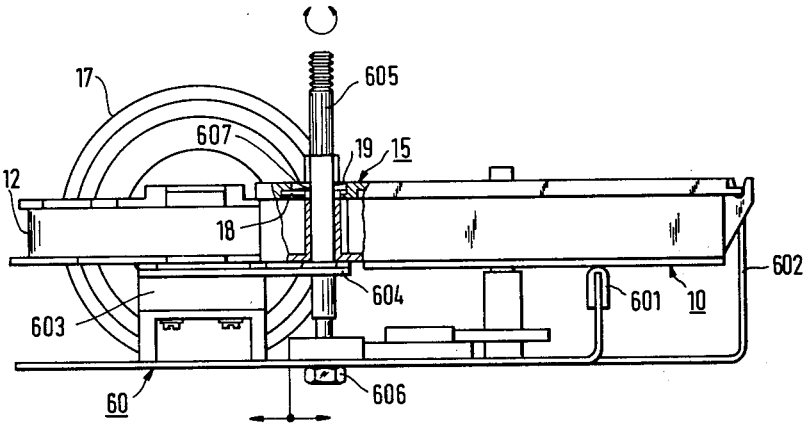
FIG. 3 shows a side elevation of the ink ribbon device in the closed state and inserted in a printing unit.

FIG. 3 shows a representation of the ink ribbon device 10 similarly to FIG. 2, but in the closed state after insertion into a printing unit or onto a numbering box carrier 60. The numbering box carrier 60 for the numbering box 17 is provided with supports 601 and 602 on which the right part of the ink ribbon device 10 rests. Onto a mounting 603 for the numbering box 17 is fastened a plate 604 which shows a retaining pin 605 at a point corresponding to the central openings 18 and 19 of FIG. 1, which pin 605 can be connected with the numbering box carrier 60 proper by a bolt 606. In the region of the openings 18 and 19 is represented the ink ribbon device 10 in a section in FIG. 3, and it can be seen that the retaining pin 605 can be provided with a central fastener 607 through which the hinged cover 15 is retained on the ink ribbon device 10 in the closed position and the ink ribbon device 10 in turn is retained on the numbering box carrier 60. The locking elements of the fastener 607 which are required for this are represented in more detail in FIG. 3, and for this, various possibilities are obvious to one skilled in the art, e.g. wedge-shaped elements which are locked by twisting the retaining pin 605 on elements assigned to it in the ink ribbon device 10.

The support 602 can be constructed in such a way that it acts on the locking elements 408 when these are in the position shown in broken lines in FIG. 1. This assures that the drive for the ink ribbon 12 is engaged when the ink ribbon device 10 is inserted in a printing unit.

Instead of pins 154, indentations may also be provided in the hinged cover 15 into which indentations the prolonged shafts of the rollers 302 and 403 are inserted when the hinged cover 15 is closed.

It is to be understood that the invention has been described with reference to a specific illustrative embodiment and that the foregoing description is not to be construed in a limiting sense.

The embodiment of the invention in which an exclusive property or privilege is claimed is defined as follows:

1. An ink ribbon storage and guide device constructed for use in combination with but selectively independently removable from a printer and comprising:

a body defining a contoured interior storage compartment and an elongated ink ribbon guide path around at least a portion of the perimeter of said body, inlet and outlet means in said body and disposed at respective spaced points adjacent said storage compartment, said ribbon guide path being substantially completely internal of said body but exiting from said body in at least one perimeter location for association with a printer head, said body further defining an open interior volume adjacent said location for occupation by a printer head when said body is operatively installed in a printer, drive roller means mounted on the body adjacent said inlet means for causing an ink ribbon to be driven from said outlet means to said inlet means by way of the guide path; and an ink ribbon magazine having substantially the same dimensions and contours of said contoured storage compartment and being independently removably disposable within said storage compartment, said magazine having an outlet opening which is adjacent said outlet means and an inlet opening adjacent said inlet means when said magazine is disposed within said storage compartment, said ink ribbon magazine comprising a closed plastic container having permanently disposed therein an endless ink ribbon loop an interchangeable portion of which is extensible from said magazine for location with said guide path when said magazine is located in said storage compartment for use in printing operations and being wholly removable from said body and said drive roller means independent of the removal of said body from said printer.

2. Ink ribbon device as claimed in claim 1, characterized in that the ribbon guide device contains an inking device for the ink ribbon and arranged in the path of the ink ribbon.

3. Ink ribbon device as claimed in claim 2, characterized in that the inking device is arranged between the printing location and the inlet opening of the ink ribbon magazine.

4. Ink ribbon device as claimed in claim 2, characterized in that the drive roller means are arranged between the inking device and the inlet opening.

5. Ink ribbon device as claimed in claim 2, characterized in that the section of the ribbon guide device which receives the inking device is constructed in trough shape.

6. Ink ribbon device as claimed in claim 2, characterized in that the inking device includes an inking roller in contact with the ink ribbon and a feed roller rolling on said inking roller, which feed roller is preferably replaceable and which accumulates printing ink.

7. An ink ribbon storage and guide device constructed for use in combination with but selectively independently removable from a printer and comprising:

a body defining a contoured interior storage compartment and an elongated ink ribbon guide path around at least a portion of the perimeter of said body, inlet and outlet means in said body and disposed at respective spaced points adjacent said storage compartment, said ribbon guide path being substantially completely internal of said body but exiting from said body in at least one perimeter location for association with a printer head, said body further defining an open interior volume adjacent said location for occupation by a printer head when said body is operatively installed in a printer, driver roller means mounted on the body adjacent said inlet means for causing an ink ribbon to be driven from said outlet means to said inlet means by way of the guide path; and an ink ribbon magazine having substantially the same dimensions and contours of said contoured storage compartment and being independently removably disposable within said storage compartment, said magazine having an outlet opening which is adjacent said outlet means and an inlet opening adjacent said inlet means when said magazine is disposed within said storage compartment, said ink ribbon magazine comprising a closed plastic container having permanently disposed therein an endless ink ribbon loop, an interchangeable portion of which is extensible from said magazine for location within said guide path when said magazine is located in said storage compartment for use in printing operations and being wholly removable from said body and said driver roller means independent of the removal of said body from said printer;

said ink ribbon device further including a braking device acting on the ink ribbon disposed adjacent the outlet opening and pressed flexibly on the ink ribbon, the combination further comprising an actuating element mounted externally of the ink ribbon device and interconnected with the braking device to move the braking device between a first position in which the braking device presses flexibly against the ink ribbon and a second position in which the braking device is removed from the ink ribbon.

8. Ink ribbon device as claimed in claim 7, characterized in that the drive roller means include a driving roller interacting with a back-up roller which driving roller can be coupled with a drive, and that the back-up roller can be moved away from the ink ribbon or from the driving roller in a slide guide and, in an open position reached by the movement, can be locked relative to the slide guide.

9. Ink ribbon device as claimed in claim 7, characterized in that in the path of the ink ribbon, a chamber is placed beyond the outlet opening of the ink ribbon magazine and inside the ribbon guide device, which chamber contains stationary guide elements for the formation of a Mobius strip in the ink ribbon.

10. Ink ribbon device as claimed in claim 9, characterized in that the ink ribbon magazine comprises an approximately square cross section.

11. Ink ribbon device as claimed in claim 9, characterized in that the ink ribbon magazine at its inlet opening includes a wall having a part which narrows the inlet opening down to the size of a slot, which wall part is constructed as a slotted plate which can be drawn out from the wall.

12. Ink ribbon device as claimed in claim 11, characterized in that the slotted plate is provided with a part protruding above the top side of the ink ribbon magazine and forming a handle.

13. Ink ribbon device as claimed in claim 9, characterized by a hinged cover covering the compartment for the ink ribbon magazine, the driver roller means and the chamber containing the Mobius strip.

14. Ink ribbon device as claimed in claim 13, characterized in that the hinged cover is connected with the ink ribbon device by way of open hinge joints.

15. Ink ribbon device as claimed in claim 13, characterized in that the hinged cover includes a locking projection for the braking device in its braking position.

16. Ink ribbon device as claimed in claim 15, characterized in that concentric openings in the ribbon guide device and the hinged cover are provided in an approximately central position in the ink ribbon device for receiving a locking pin.

* * * * *